US011602188B2

(12) United States Patent
Gibson

(10) Patent No.: US 11,602,188 B2
(45) Date of Patent: Mar. 14, 2023

(54) REVERSIBLE AND ADJUSTABLE HEADBAND WITH SILICONE INSERT FOR SECURING WIG

(71) Applicant: CreatedHair, Inc., Los Angeles, CA (US)

(72) Inventor: Amy Gibson, Los Angeles, CA (US)

(73) Assignee: CREATEDHAIR, INC., Los Angeles, CA (US)

( * ) Notice: Subject to any disclaimer, the term of this patent is extended or adjusted under 35 U.S.C. 154(b) by 205 days.

(21) Appl. No.: 16/796,099

(22) Filed: Feb. 20, 2020

(65) Prior Publication Data

US 2020/0268083 A1 Aug. 27, 2020

Related U.S. Application Data

(60) Provisional application No. 62/808,562, filed on Feb. 21, 2019.

(51) Int. Cl.

| | |
|---|---|
| ***A45D 8/40*** | (2006.01) |
| ***A41G 5/00*** | (2006.01) |
| ***A45D 8/36*** | (2006.01) |

(52) U.S. Cl.

CPC ..... *A41G 5/0026* (2013.01); *A45D 8/36* (2013.01)

(58) Field of Classification Search

CPC ... A45D 8/00; A45D 8/34; A45D 8/36; A41G 5/0026; A41G 5/0073; A41G 3/0041; A41G 3/0033; A41G 3/0091; A41D 20/00; A41D 2023/002; A42C 5/02

See application file for complete search history.

(56) References Cited

U.S. PATENT DOCUMENTS

| | | | | |
|---|---|---|---|---|
| 1,545,881 A | | 7/1925 | Cohen | |
| 5,377,360 A | * | 1/1995 | Fleitman | A41D 20/00 2/DIG. 11 |
| 5,806,535 A | | 9/1998 | Becker | |

(Continued)

FOREIGN PATENT DOCUMENTS

| | | | |
|---|---|---|---|
| CN | 1868355 | A | 11/2006 |
| CN | 101677642 | A | 3/2010 |

(Continued)

OTHER PUBLICATIONS

International Search Report and Written Opinion in International Application No. PCT/US2020/019013, dated Jun. 19, 2020 in 12 pages.

(Continued)

*Primary Examiner* — Rachel R Steitz

(74) *Attorney, Agent, or Firm* — Aura IP Law, PC

(57) ABSTRACT

Disclosed herein are embodiments of a headband for securing a wig on a user's head, methods for manufacturing a wig-securing headband, and methods for wearing a wig-securing headband. The headband can have an exterior panel and an interior panel. The interior panel can include an opening. The headband can include an intermediate layer disposed between the exterior panel and the interior panel. The headband can include a silicone member coupled to the intermediate layer. The silicone member can extend along a longitudinal axis of the headband. At least a portion of the silicone member can be disposed in the opening of the interior panel.

18 Claims, 9 Drawing Sheets

(56) References Cited

U.S. PATENT DOCUMENTS

| | | | | |
|---|---|---|---|---|
| 6,567,991 | B1 * | 5/2003 | Holslag | A42C 5/02 2/181.4 |
| 8,261,753 | B2 | 9/2012 | Newman et al. | |
| D879,382 | S | 3/2020 | Ning | |
| D893,104 | S | 8/2020 | Ning | |
| 10,881,159 | B2 | 1/2021 | Geisinsky et al. | |
| 10,945,477 | B2 | 3/2021 | Geisinsky et al. | |
| 2003/0029467 | A1 | 2/2003 | Katon | |
| 2004/0200494 | A1 | 10/2004 | Lee | |
| 2006/0085891 | A1 * | 4/2006 | Larkin | A45D 8/36 2/171 |
| 2007/0044814 | A1 | 3/2007 | Belo | |
| 2010/0206323 | A1 * | 8/2010 | August | A41D 20/00 132/273 |
| 2011/0023902 | A1 | 2/2011 | Cho | |
| 2011/0041866 | A1 | 2/2011 | Bermeister | |
| 2011/0120485 | A1 | 5/2011 | Newman et al. | |
| 2011/0186065 | A1 | 8/2011 | Inoue et al. | |
| 2011/0191938 | A1 * | 8/2011 | Elliott | A42C 5/02 2/181.2 |
| 2013/0019889 | A1 | 1/2013 | Palmer-Rogers | |
| 2014/0251362 | A1 | 9/2014 | Lee | |
| 2015/0013708 | A1 | 1/2015 | Chamberlain | |
| 2015/0013710 | A1 | 1/2015 | Buzaglo et al. | |
| 2016/0345706 | A1 | 12/2016 | Passarello | |
| 2017/0095026 | A1 | 4/2017 | Chung | |
| 2018/0007988 | A1 | 1/2018 | Kim et al. | |
| 2018/0332942 | A1 | 11/2018 | Saito | |
| 2018/0343947 | A1 | 12/2018 | Sturdivant | |

FOREIGN PATENT DOCUMENTS

| | | | |
|---|---|---|---|
| CN | 103720105 | A | 4/2014 |
| CN | 107205510 | A | 9/2017 |
| JP | 11-323646 | A | 11/1999 |
| KR | 20-1991-0003009 | Y1 | 5/1991 |
| KR | 101215583 | B1 | 12/2012 |
| KR | 20-0485740 | Y1 | 2/2018 |
| WO | WO 2011066090 | A2 | 6/2011 |
| WO | WO 2011066090 | A3 | 10/2011 |
| WO | WO 03/013295 | A1 | 2/2013 |

OTHER PUBLICATIONS

DIY Wig Grip Band Silicone Sided Anti-Slip with Silicon Black, Copyright© 1995-2020 eBay Inc., https://www.ebay.com/i/283292045603?chn=ps&norover=1&mkevt=1&mkrid=711-117182-37290-0&mkcid=2&itemid=283292045603&targetid=537215873208&device=m&mktype=pla&googleloc=9030950&poi=campaignid=6470552775&mkgroupid=77829366456&rsatarget=pla-537215873208&abcld=1139336&merchantid=118982009&gclid=EAlalQobChMI2Lms4Kmx5QIV0xitBh2vMADGEAQYBiABEgLtkfD_BwE, downloaded May 18, 2020 in 3 pages.

Ferdinand's Wigs Comfy Grip Deluxe Band, Vogue Wigs, Vogue, Inc. © 2019, https://www.voquewics.com/comfy-grip-deluxe-band.html, downloaded May 15, 2020 in 4 pages.

Red by Kiss Silicone Wig Band Stretchy & Comfy One Size Fits All HWG03 Black, Copyright © 1995-2020 eBay Inc., https://www.ebay.com/itm/Red-by-Kiss-SILICONE-WIG-BAND-Stretchy-Comfy-One-Size-Fits-All-HWG03-Black-/254389043161, downloaded May 15, 2020 in 2 pages.

The True Styles Wig Gripper Double Silicone Strips Side Secure Fit Hold, Copyright© 1995-2020 eBay Inc., https://www.ebay.com/i/332549028245?rt=nc&_trkparms=aid%3D1110001%26algo%3DSPLICE.SIM%26a0%3D2%26asc%3D225073%26meld%3D65212298aae6a4b058226a6b1f1a13fbb%26pid%3D100677%26rk%3D7%26rkt%3D30%26mehot%3Dnone%26sd%3D133374761583%26itm%3D332549028245%26pmt%3D0%26noa%3D1%26pg%3D2386202%26algv%3D. Default, downloaded May 18, 2020 in 3 pages.

Amazon.com, "GripCap by Milano Collection All-in-1 WiGrip Comfort Band and Wig Cap in Tan", https://www.amazon.com/gripCap-Milano-Collection-WiGrip-Comfort/dp/B0741QPWW1/?th=1, downloaded Jan. 19, 2022, in 14 pages.

Amazon.com, "Milano Collection Wig Grip Original WiGrip Band for Lace Front | Velvet Wig Holder Comfort Headbands for Women | Tension Free Glueless Wig Install | Wig Accessories for Multiple Wigs, Nude, 1 Pack", https://www.amazon.com/MILANO-COLLECTION-Original-Tension-Free-Glueless/dp/B00BD7EBVS/?th=, downloaded Jan. 11, 2022, in 14 pages.

Amazon.com, Milano WiGrip Review, dated Nov. 14, 2015, https://www.amazon.com/MILANO-COLLECTION-Original-Tension-Free-Glueless/product-reviews/B00BD7EBVS/ref=cm_cr_getr_d_paging_btm_next_26?ie=UTF8&reviewerType=all_reviews&pageNumber=26&sortBy=recent&filterByKeyword=wig+grip, in 1 page.

Amazon.com, Milano WiGrip Review, dated May 29, 2017, https://www.amazon.com/MILANO-COLLECTION-Original-Tension-Free-Glueless/product-reviews/B00BD7EBVS/ref=cm_cr_getr_d_paging_btm_next_14?ie=UTF8&reviewerType=all_reviews&pageNumber=14&sortBy=recent&filterByKeyword=Five+Stars, in 1 page.

Amazon.com, Milano WiGrip Review, dated Mar. 24, 2018, https://www.amazon.com/MILANO-COLLECTION-Original-Tension-Free-Glueless/product-reviews/B00BD7EBVS/ref=cm_cr_getr_d_paging_btm_next_3?ie=UTF8&reviewerType=all_reviews&pageNumber=3&sortBy=recent&filterByKeyword=disappointed, in 1 page.

Amazon.com, "GEX Beauty Flexible Velvet Wig Grip Scarf Head Hair Band Wig Band Adjustable Fastern (Nude)", https://www.amazon.com/Beauty-Flexible-Velvet-Adjustable-Fastern/do/B01M7y4E7C/ref=er_1_3?keywords=gex%2Bhead%2Bhead%2Bband&gid=1641577922&er=8-3&th=1, downloaded Jan. 12, 2002, in 12 pages.

Headcovers Unlimited, "Wig Grip | Wig Gripper Headband | Holds Wigs & Head Scarves in Place", https://www.headcovers.com/wig-gripper-holds-wigs-scarves-and-headwear-in-place/, downloaded Jan. 12, 2022, in 5 pages.

VogueWigs Timeless Catalog, dated Oct. 25, 2017, https://issuu.com/voguewigs/docs/voguewigs_timeless_catalog, in 4 pages.

YouTube.com, "Gex Wig Grip Keep Your Wigs in Place!", dated May 10, 2018, https://www.youtube.com/watch?v=iXUliqFZt8, in 1 page.

YouTube.com, "Save Your Edges | Never Glue Another Lace Frontal Wig | Again Stops Wigs From Sliding | Lumiere Hair", dated Jan. 23, 2018, https://www.youtube.com/watch?v=wOl0yMmv0sE, in 1 page.

YouTube.com, "Edges SAFE & Wig on Lock! Milano WiGrip Review & Demo", dated Jan. 5, 2017, https://www.youtube.com/watch?v=6pQmkEZ895w, in 1 page.

Complaint for Patent Infringement, United States District Court Central District of California, Western Division, Case No. 2:21-cv-08086-JAK-RAO, filed Oct. 11, 2021.

Answer to Complaint for Patent Infringement, United States District Court Central District of California, Western Division, Case No. 2:21-cv-08086-JAK-RAO, filed Dec. 22, 2021.

Opening Claim Construction Brief for Defendant, United States District Court Central District of California, Western Division, Case No. 2:21-cv-08086-JAK-RAO, filed May 23, 2022.

Plaintiff NG Imports Inc.'s Opening Markman Brief, United States District Court Central District of California, Western Division, Case No. 2:21-cv-08086-JAK-RAO, filed May 23, 2022.

Responsive Claim Construction Brief for Defendant, United States District Court Central District of California, Western Division, Case No. 2:21-cv-08086-JAK-RAO, filed Jun. 13, 2022.

Claim Construction Presentation for Defendant, United States District Court Central District of California, Western Division, Case No. 2:21-cv-08086-JAK-RAO, filed Jun. 13, 2022.

Plaintiff NG Imports Inc.'s Responsive Markman Brief, United States District Court Central District of California, Western Division, Case No. 2:21-cv-08086-JAK-RAO, filed Jun. 13, 2022.

Plaintiff NG Imports Inc.'s Markman Hearing Presentation, United States District Court Central District of California, Western Division, Case No. 2:21-cv-08086-JAK-RAO, filed Jun. 14, 2022.

(56) References Cited

OTHER PUBLICATIONS

First Amended Complaint, United States District Court Central District of California, Western Division, Case No. 2:21-cv-08086-JAK-RAO, filed Jun. 30, 2022.
Answer to First Amended Complaint, United States District Court Central District of California, Western Division, Case No. 2:21-cv-08086-JAK-RAO, filed Jul. 22, 2022.
Order Regarding Claim Construction, United States District Court Central District of California, Western Division, Case No. 2:21-cv-08086-JAK-RAO, Sep. 21, 2022.

* cited by examiner

REVERSIBLE AND ADJUSTABLE HEADBAND WITH SILICONE INSERT FOR SECURING WIG

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

The present application claims the benefit of U.S. Patent Application No. 62/808,562, filed Feb. 21, 2019, which is hereby incorporated by reference in its entirety herein.

BACKGROUND

Field

The present disclosure is generally related to headbands for securing wigs and related methods.

Description

An individual's hair is commonly identified as a foundation of outer beauty and inner confidence. According to the American Academy of Dermatology, about 80 million men and women in the United States alone suffer from a myriad of medical hair loss issues including alopecia, a type of hereditary hair loss that can result in pattern or complete baldness. Hair loss may also occur in individuals undergoing chemotherapy treatment, hormone imbalances, Diabetes, or those who experience hair loss with old age. To cover the appearance of hair loss, some individuals wear wigs occasionally or on a daily basis. Wigs may also be worn by individuals who want to change hairstyles without cutting, dying, repeatedly flat ironing or otherwise processing their natural hair. Wigs may be secured to the head in a variety of ways, including using bobby pins, clips, adhesives, and headbands.

With conventional wig retention techniques, wigs have a high likelihood of moving around on users' heads, or even falling off of users' heads, if not secured carefully. The risk of this can cause individuals who wear wigs embarrassment, humiliation, and considerable stress, and increased stress is linked to increased hair loss, thus exacerbating the problem. Individuals who wear wigs desire discretion and peace of mind that their wigs will stay in place and will not change positions while being worn. Individuals who wear wigs want to be able to move through their days without constantly worrying about whether their wigs have shifted positions and their secret being revealed. Accordingly, there is a desire for better, more comfortable wig retention methods.

SUMMARY

The present disclosure describes various embodiments of headbands for effectively and comfortably securing a wig to a user's head. According to some embodiments, an adjustable headband for securing a wig on a user's head comprises: an exterior panel that extends along a length of the headband; an interior panel that forms an opening on an interior side of the headband; an intermediate layer disposed between the exterior panel and the interior panel, the intermediate layer connected to at least the interior panel by stitching that extends along a perimeter of the opening, wherein the exterior panel is connected to the interior panel by at least a first pattern of stitching that extends along a perimeter of the headband and a second pattern of stitching that extends from the perimeter of the headband to the perimeter of the opening; a silicone member coupled to the intermediate layer and positioned to be exposed through the opening on the interior side of the headband; and one or more adjustable fasteners configured to detachably couple a first end of the headband to a second end of the headband in different relative positions to adjust a fit of the headband on the user's head.

In some embodiments, the second pattern of stitching comprises a plurality of lines extending diagonally between the perimeter of the headband and the perimeter of the opening. In some embodiments, the opening extends longitudinally along the length of the headband. In some embodiments, the interior panel comprises at least two pieces of fabric separated laterally by the opening.

According to some embodiments, a headband for securing a wig on a user's head comprises: an exterior panel; an interior panel, the interior panel comprising an opening; an intermediate layer disposed between the exterior panel and the interior panel; and a silicone member coupled to the intermediate layer, the silicone member extending along a longitudinal axis of the headband, wherein at least a portion of the silicone member is disposed in the opening of the interior panel.

In some embodiments, the interior panel is attached to the intermediate layer at an upper edge and a lower edge of the intermediate layer, the silicone member disposed between the upper edge and the lower edge of the intermediate layer. In some embodiments, the exterior panel comprises a first fastener and the interior panel comprises a second fastener configured to engage the first fastener. In some embodiments, the first and second fasteners comprise hook-and-loop fasteners. In some embodiments, each of the exterior panel and the interior panel comprises velour.

In some embodiments, the headband is reversible such that each of the exterior panel and the interior panel can be configured to contact the user's head.

In some embodiments, the headband further comprises diagonal stitching configured to reduce relative movement between portions of the exterior panel and portions of the interior panel.

In some embodiments, the headband further comprises a first elastic thread and a second elastic thread parallel to the first elastic thread, wherein the first elastic thread extends longitudinally along a central upper portion of the headband and the second elastic thread extends longitudinally along a central lower portion of the headband.

In some embodiments, the headband further comprises a transparent segment, the transparent segment configured to contact a region of the user's head that aligns with the location of the wig where hair parts.

According to some embodiments, a headband for securing a wig on a user's head comprises: a first panel; a second panel, the second panel comprising an opening; an intermediate layer disposed between the first panel and the second panel; and an elastomer coupled to the intermediate layer, wherein at least a portion of the elastomer is disposed in the opening of the second panel.

In some embodiments, the second panel comprises at least two pieces of fabric separated laterally by the opening.

In some embodiments, the elastomer comprises a first silicone member extending along a longitudinal axis of the headband. In some embodiments, the headband further comprises a second silicone member extending along the longitudinal axis of the headband, wherein the second silicone member is parallel to the first silicone member.

In some embodiments, the elastomer comprises a first slanted silicone member disposed at an angle relative to vertical. In some embodiments, the headband further comprises a second slanted silicone member spaced apart from the first slanted silicone member along a longitudinal axis of the headband.

In some embodiments, the first panel comprises a first fastener and the second panel comprises a second fastener configured to engage the first fastener.

In some embodiments, the headband further comprises diagonal stitching configured to reduce relative movement between portions of the first panel and portions of the second panel.

In some embodiments, the headband further comprises a first elastic thread and a second elastic thread parallel to the first elastic thread, wherein the first elastic thread extends longitudinally along a central upper portion of the headband and the second elastic thread extends longitudinally along a central lower portion of the headband.

In some embodiments, the headband further comprises a transparent segment, the transparent segment configured to contact a region of the user's head that aligns with the location of the wig where hair parts.

BRIEF DESCRIPTION OF THE DRAWINGS

The foregoing and other features, aspects, and advantages of the present disclosure are described in detail below with reference to the drawings of various embodiments, which are intended to illustrate and not to limit the disclosure. The drawings comprise the following figures in which.

DETAILED DESCRIPTION OF CERTAIN EMBODIMENTS

Figure 1:
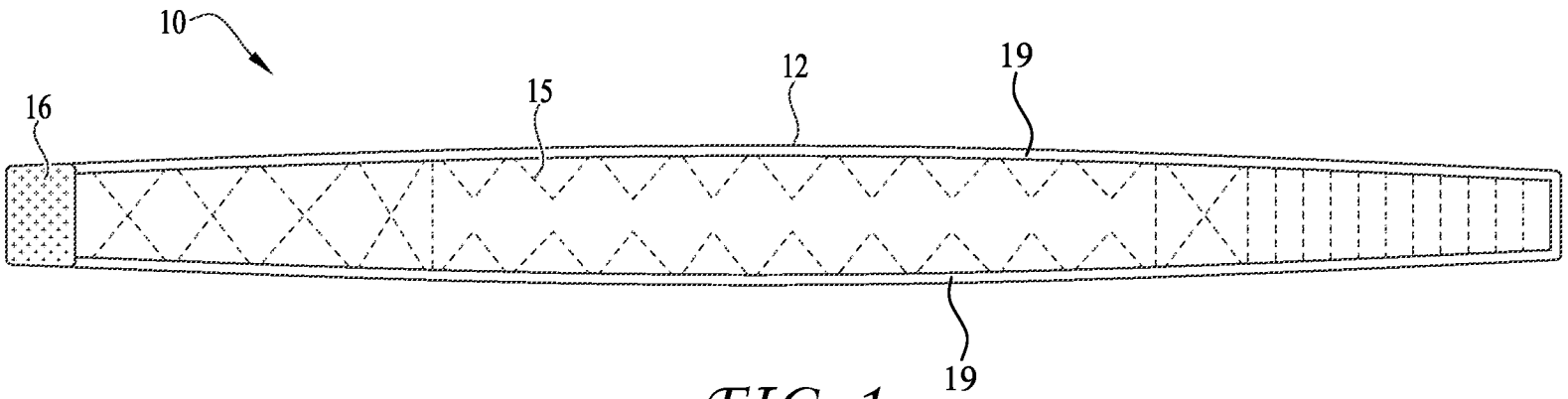
FIG. 1 shows the exterior side of an embodiment of a wig securing headband.

Although several embodiments, examples, and illustrations are disclosed below, it will be understood by those of ordinary skill in the art that the inventions described herein extend beyond the specifically disclosed embodiments, examples, and illustrations and include other uses of the inventions and obvious modifications and equivalents thereof. Embodiments of the inventions are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments. In addition, embodiments of the inventions can comprise several novel features and no single feature is solely responsible for its desirable attributes or is essential to practicing the inventions herein described. Further, it should be understood that any of the examples herein are non-limiting. As such, the inventions disclosed herein are not limited to any particular embodiments, aspects, concepts, structures, functionalities, or examples described herein.

With conventional wig retention techniques, wigs have a high likelihood of moving around on users' heads, or even falling off of users' heads, if not secured carefully. The risk of this can cause individuals who wear wigs embarrassment, humiliation, and considerable stress, and increased stress is linked to increased hair loss, thus exacerbating the problem. Individuals who wear wigs desire discretion and peace of mind that their wigs will stay in place and will not change positions while being worn. Individuals who wear wigs want to be able to move through their days without constantly worrying about whether their wigs have shifted positions and their secret being revealed. Accordingly, there is a desire for better, more comfortable wig retention methods.

The present disclosure describes various embodiments of improved headbands for securing a wig on a user's head. The embodiments presented herein have a variety of benefits over prior techniques for securing wigs. For example, some embodiments comprise a silicone member sewn into or otherwise captured between multiple layers of a headband and positioned such that at least a portion of the silicone member is presented through an opening in the headband. The construction of such headbands, as described in detail below, can provide various benefits over prior wig retention methods, such as more effectively retaining the wig in place, being more comfortable to wear for extended periods, being more durable, and/or being less noticeable underneath a wig. Some embodiments are also adjustable and/or reversible, to allow a user to customize the fit and/or function to their specific situation. For example, as described in greater detail below, a user that has no hair may most effectively use such a headband with the silicone member positioned against their scalp, while a user that is placing a wig over their own hair may most effectively use such a headband reversed, with the silicone member positioned against the interior of the wig.

Wigs may be secured to the head in a variety of ways. A basic way may be to place the wig on the head and secure the perimeter of the wig to the hair along the hairline using bobby pins. Another way is to use and secure a wig including small comb-like clips sewn onto the perimeter of the inner lining of the wig. When using this type of wig, the teeth from the comb slide through the hair and become secure to the head along the hairline. A problem with securing a wig using this method is that the comb-like clips may become entangled with the user's hair and pull out the hair during use and/or when the user removes the wig. Securing a wig using the bobby pin or comb-like clip methods may also be problematic for individuals with minimal or no hair, or for those with brittle, weak hair as the bobby pins and clips can place pressure on the follicle and/or rip hair from the scalp upon removal. Additionally, the methods may not provide the security needed for the wig to stay in place throughout the day or even during windy weather conditions.

Another way to secure a wig is to apply an adhesive such as a water-based glue or double-sided tape to the scalp and the inner lining of the wig. Using this method, the wig may remain on the head anywhere from a few days to about 2-3 weeks. This method of securing a wig may be problematic if the adhesive is accidentally applied to the individual's hair, as the hair may be inadvertently removed when removing the wig. Due to the long-lasting effects of the adhesive, this method also limits the ability to remove and style the wig as often as desired. Additionally, the adhesive may be difficult to remove from the wig, damaging the wig in the process.

Another way to secure a wig is to use a headband around the user's scalp, and to secure the wig to the headband. Such a headband may consist of a fabric, such as crushed velvet, or may consist of a silicone gel. Some problems with this method are that typical headbands may allow the wig and/or the headband to move backwards and away from the front hairline, and they may be uncomfortable to wear for long durations of time.

There is a need for a product to comfortably secure a wig to a user who may or may not have hair, and which prevents the wig from moving back and away from the front hairline or from being unintentionally removed. There is also a need for a product that gives the user the ability to securely affix the product to the head while also creating the comfort they desire to reduce the possibility of headaches and other symptoms. There is also a need for a product that allows a user to intentionally remove a wig as often as desired and which does not damage the hair during intended wig removal. The present disclosure describes various embodiments of headbands that exhibit some or all of these benefits.

Example Wig-Retaining Headbands

Figure 2:
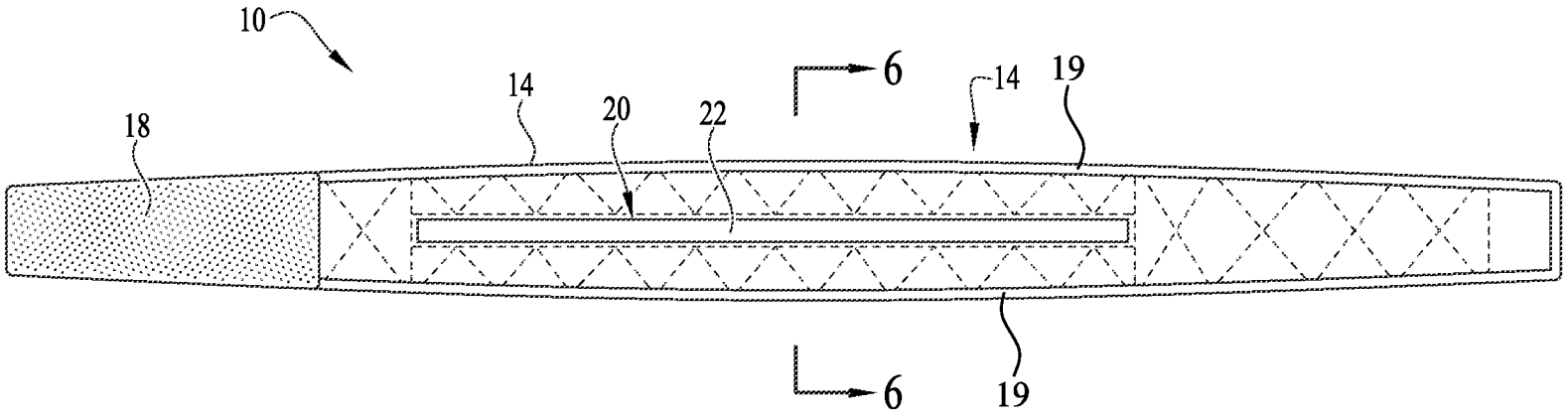
FIG. 2 shows the interior side of the headband of FIG. 1.

FIGS. 1-2 show one embodiment of an adjustable, reversible headband with silicone insert 10. The headband 10 includes an exterior panel 12 defining the exterior side of the headband 10, and an interior panel 14 defining the interior side of the headband 10. The exterior panel 12 and interior panel 14 of the headband 10 are made preferably of crushed velvet material, although other suitable materials may be used, such as materials with a cotton or polyester blend. The material of the exterior panel 12 and interior panel 14 of the headband 10 preferably has some elastic properties; however, as described below, it can be desirable for the assembled headband 10 to be at least somewhat limited in its elastic properties and/or its ability to stretch along the length or longitudinal direction of the headband. In a preferred embodiment, the exterior panel 12 and interior panel 14 are affixed together during a sewing process. As a result of the sewing process, several lines of stitching 15 may be made through the exterior panel 12 and interior panel 14 to ensure the panels are securely affixed to one another and to minimize stretching or buckling of the fabric resulting from repetitive use. Desirably, the lines of stitching 15 are oriented in a diagonal direction, or at least in a direction or orientation that is not perpendicular to the longitudinal axis of the headband, which can help to reduce the elasticity or ability to stretch of the completed headband. The lines of stitching 15 may be formed by a straight stitch, an anchor stitch, a basting stitch, or any other suitable stitching technique. In some embodiments, the stitching 15 may not necessarily form straight lines, such as if zigzag stitch or other non-linear stitching is used. Desirably, however, the general path followed by the stitching 15 is non-perpendicular to the longitudinal axis of the headband. It should be noted that the disclosure herein is not limited to only non-perpendicular stitching 15; however, non-perpendicular stitching 15 can be beneficial, such as to reduce the ability of the completed headband 10 to stretch along the longitudinal axis.

Other stitching can also be used to affix the exterior panel 12 to the interior panel 14. For example, the outer perimeters or edges 19 of the panels may be affixed to one another using stitching, such as a satin stitch, blanket stitch, running stitch, and/or any suitable stitch. In some embodiments, it is desirable to use a stitch that can at least somewhat or completely hide the edges 19 of the panels, for decorative purposes.

In some embodiments, the exterior panel 12 and interior panel 14 may be affixed through adhesion or other means (in lieu of, or in additional to stitching). The exterior panel 12 and interior panel 14 of the headband 10 are substantially identical in size and shape, and may be an elongated rectangle, although they do not necessarily have to be the same size and shape. In some embodiments, the outer perimeter shape may be wider in the middle and taper to a thinner width at the ends. Further, at described below, the exterior and/or interior panels 12, 14 do not necessarily have to be formed as a single piece. For example, in the embodiment shown in FIG. 7, described below, the interior panel 114 desirably comprises multiple pieces separated by opening 120. Returning to FIGS. 1-2, the headband 10 is preferably about 20-22.5 inches long, although the headband 10 may be shorter or longer lengths.

Figure 3:
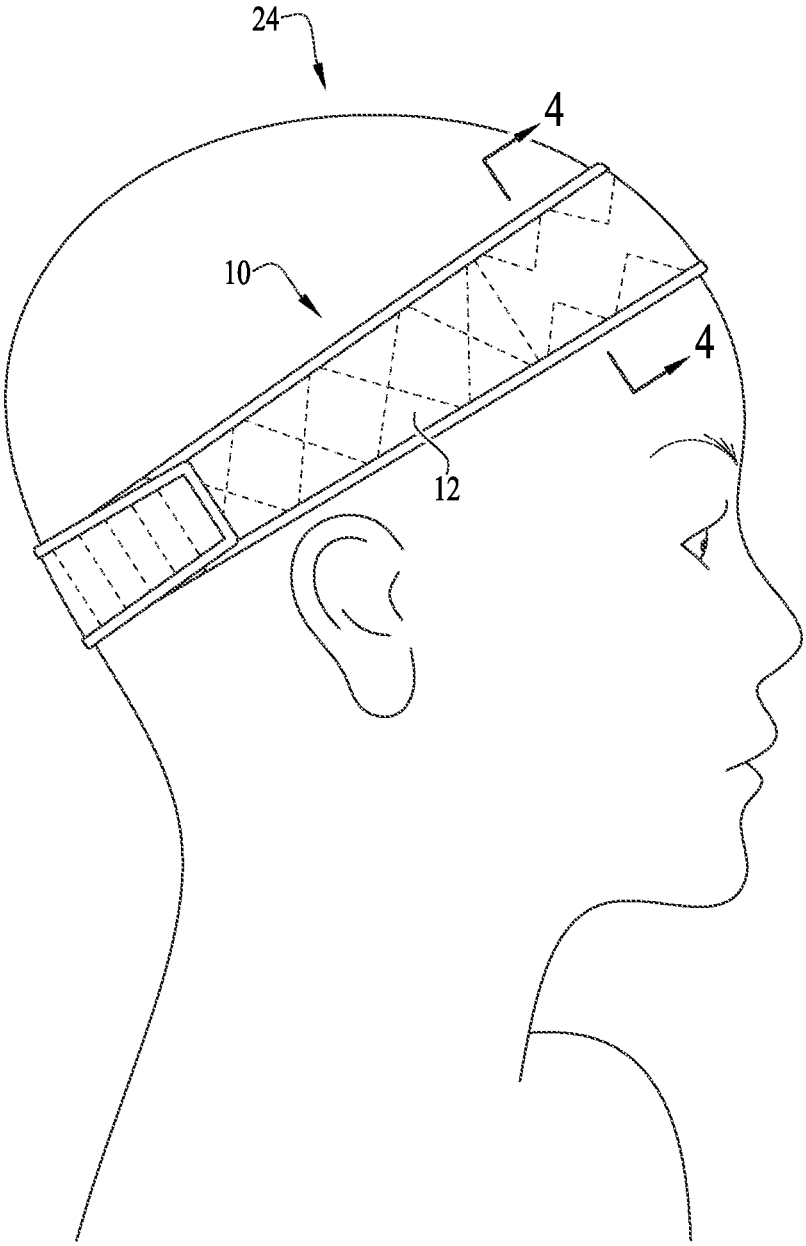
FIG. 3 shows the headband of FIG. 1 as worn on a user's head.

Still referring to FIGS. 1-2, the exterior panel 12 includes a first fastener 16 adjacent one end of the exterior panel 12, and the interior panel 14 includes a corresponding second fastener 18 on one end of the interior panel 12. It should be noted that the orientation of the two ends of the headband 10 is flipped between FIGS. 1 and 2. Accordingly, with reference to FIG. 1, the first fastener 16 is shown on a first end (the left end in this view) of the headband 10, and the second fastener 18 is hidden from view underneath a second end (the right end in this view) of the headband 10. Likewise, with reference to FIG. 2, the first fastener 18 is shown on the second end (the left end in this view) of the headband 10, and the second fastener 18 is hidden from view underneath the first end (the right end in this view) of the headband 10. In a preferred embodiment, the first fastener 16 and second fastener 18 are a hook-and-loop system such as Velcro® although other fasteners may be used such as a riveted snap fastener system (not shown) comprising a button and eyelet (not shown). In alternate embodiments where a riveted snap fastener system or other type of system is employed, the button portion of the fastener system (not shown) may be, for example, affixed to the exterior panel 12 and eyelets (not shown) may be, for example, affixed along the interior panel 14 in equidistant increments such that the size of the headband 10 may be adjusted to comfortably fit the user's head. The first fastener 16 and second fastener 18 are affixed to the headband 10 such that when the exterior panel 12 and exterior panel 14 are wrapped around a user's head and affixed together, the first fastener 16 and second fastener 18 interlock with one another (as shown in FIG. 3).

As shown in FIG. 2, the interior panel 14 includes an opening 20. An elastomer 22 is sewn or otherwise affixed onto the interior panel 14 (and/or the exterior panel 12) such that the elastomer 22 is secured between the exterior panel 12 and interior panel 14 of the headband 10, and is at least partially or fully shown through the opening 20. In a preferred embodiment, the elastomer 22 is silicone, although other elastomers 22 such as rubber may be used. The elastomer 22 is also preferably relatively thin such that when secured between the exterior panel 12 and the interior panel 14, the headband 10 is relatively flat, void of significant protrusion where the elastomer 22 is present. The elastomer 22 preferably does not buckle or otherwise morph, and may contribute to preventing the headband 10 from becoming stretched out from repetitive use.

One challenge with incorporating an elastomer such as silicone into the headband 10 is that stretching of the headband 10 during use and particularly over time as the headband is stretch and relaxed over repeated uses, is that the elastomer may eventually begin to crack or otherwise break down. Accordingly, at least somewhat limiting the elasticity or ability to stretch of the headband 10 can desirably help to resist the elastomer breaking down, and thus extend the useful life of the headband 10. One way to limit the elasticity or ability of the headband 10 to stretch, to accomplish this benefit, is by including stitching between the exterior and interior panels, such as the lines of stitching 15 described above, that help to reduce the ability of the exterior and interior panels to stretch along the longitudinal direction. Desirably, the lines of stitching 15 are created using a thread that has a lower elasticity than the material of the exterior and interior panels 12, 14.

With continued reference to FIG. 2, the opening 20 in this embodiment desirably extends along a longitudinal direction of the headband 10, and is desirably centered in a lateral direction. Although this opening 20 extends only partially along the length of the headband 10, other embodiments may extend fully or substantially fully along the length of the headband (such as the embodiment shown in FIG. 7, where opening desirably extends the full length, other than at the perimeter edge and at fastener 118). In the embodiment of FIG. 2, the opening 120 is approximately 10-15 mm wide in the lateral direction, although other widths may be used, such as 5-15 mm, 10-20 mm, or 20-30 mm. Further, the width of the opening 120 in the lateral direction can be desirably within a range of approximately 10-30% of the overall width of the headband 10. Other embodiments may use an opening width that is within a different range, such as, for example, 10-20%, 15-25%, 20-30%, 20-40%, 10-50%, or 10-75%.

Figure 4:
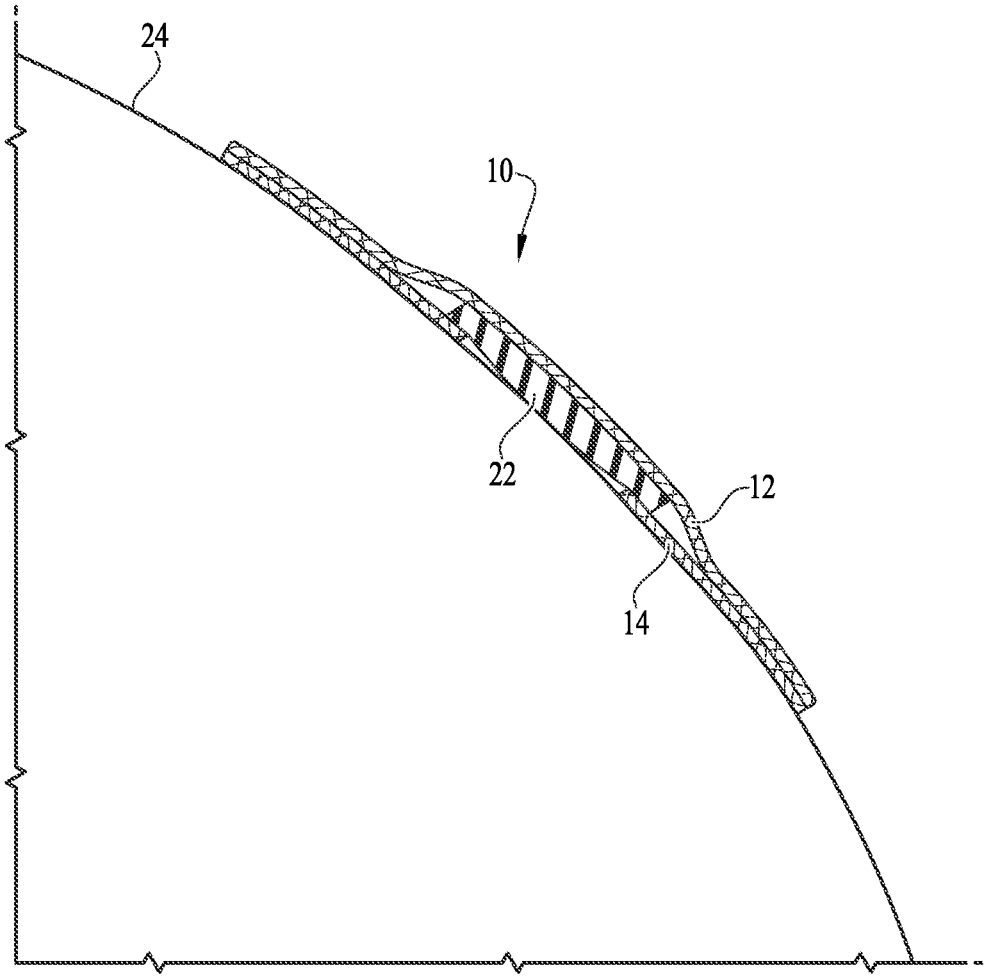
FIG. 4 is a cross-sectional view of the headband of FIG. 1 as worn on the head (as shown in FIG. 3) with the silicone insert resting flush with the user's scalp or forehead.
Figure 5:
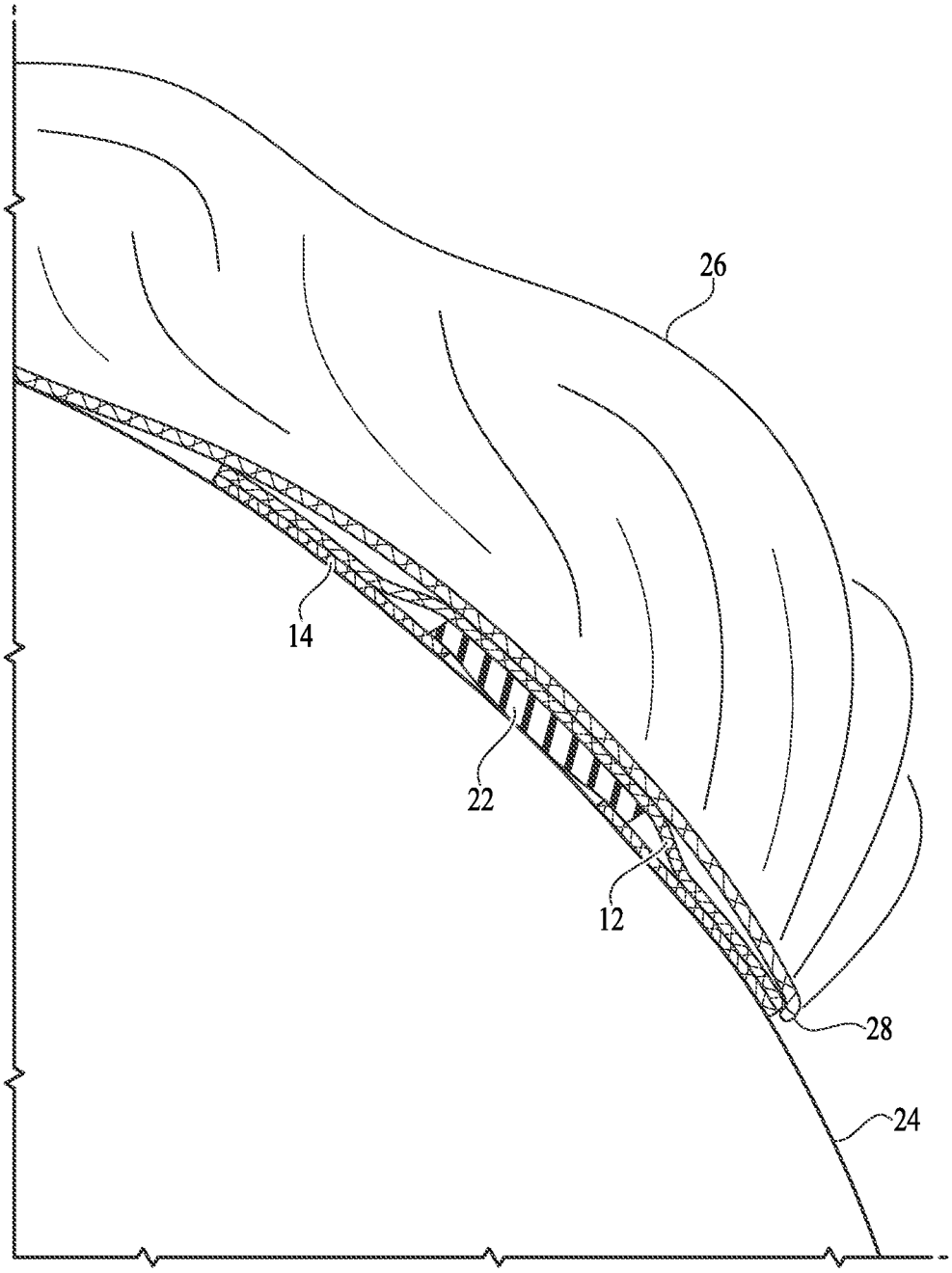
FIG. 5 is a cross-sectional view of the headband of FIG. 1 as worn on the head (as shown in FIG. 3) with the silicone insert flush with the head, and a wig secured on the headband.

Referring now to FIG. 3, the headband 10 is shown as worn on a user's head 24 positioned preferably along the hairline (not shown). In this configuration, the interior panel 14 (not shown) of the headband 10 is in direct contact with the head 24 and the second fastener 18 (not shown) is secured to the first fastener 16 (not shown). FIG. 4 shows a close-up cross-sectional view of the headband 10 as shown in FIG. 3 with the elastomer 22 resting on the head 24, preventing the headband 10 from sliding back and away from the hairline (not shown) during wear. FIG. 5 shows a close-up cross sectional view of the headband 10 as shown in FIG. 3 with the elastomer 22 resting on the head 24 and a wig 26 secured to the headband 10, the inner lining 28 of the wig 26 in direct contact with the exterior panel 12 of the headband 10. Desirably, the exterior panel 12 of the headband comprises a material that helps to retain the wig 26 to the headband. For example, the exterior panel 12 may comprise crushed velvet or velour that has a pile that falls in a particular direction, such as pointing toward one of the lateral edges of the headband, such that the pile will point generally downwards when worn as shown in FIG. 5. Such a pile orientation can help to resist the wig 24 moving upwards with respect to the headband, while the elastomer 22 can help to resist the headband moving upwards with respect to the head 24. It should be noted that the use case shown in FIGS. 3-5 is a desirable technique for user's that have no hair. For users that do have hair, it may be desirable to reverse the headband, such that the material of panel 12 helps to resist upward movement of the headband with respect to the user's hair, and the elastomer 22 helps to resist upward movement of the wig 24 with respect to the headband.

The headband 10 can desirably be relatively thin, which can help to prevent the headband 10 from creating bulk under the wig 26 and/or causing the appearance of bulk under the wig 26. Reducing the bulk associated with the headband 10 can increase the comfort of the headband 10, and/or the wig 26 and headband 10 combination, and the discretion of the wig 26 and headband 10 combination (such as by making it less apparent that the user is wearing a wig). For example, in some embodiments, the material that forms the exterior and/or interior panels 12, 14 may comprise a velvet or velour material that is approximately 1.0 mm thick. In some embodiments, the material that forms the exterior and/or interior panels is no greater than 0.75, 1.0, 1.25, or 1.50 mm thick. Further, the elastomer 22 may be approximately 1.0 mm thick in some embodiments. In some embodiments, the elastomer 22 may be no greater than 0.75, 1.0, 1.25, or 1.50 mm thick.

Figure 6:
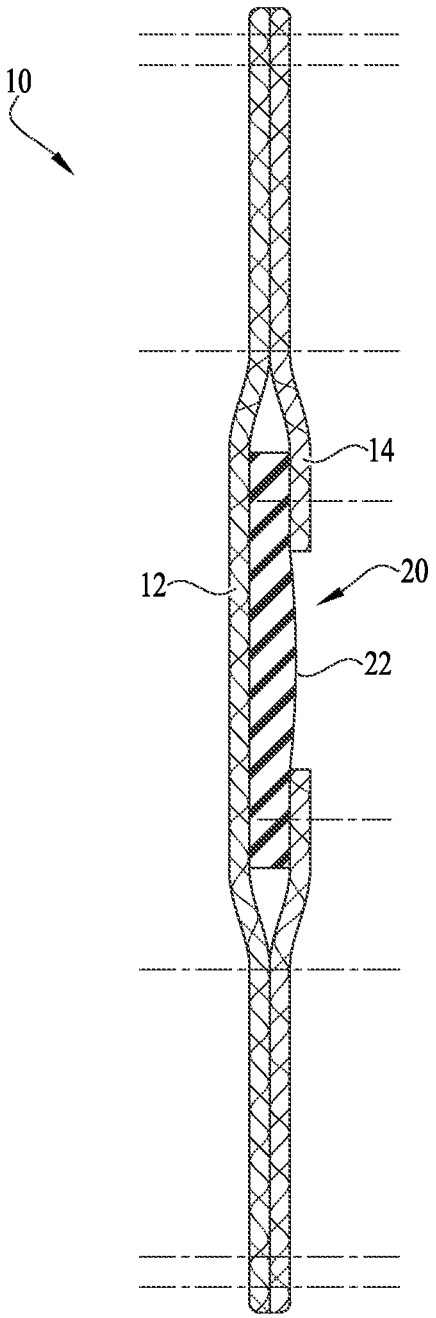
FIG. 6 is a cross-sectional view of the headband of FIG. 1, oriented as shown in FIG. 2.

FIG. 6 shows a cross-sectional view of the headband 10 oriented as shown in FIG. 2. In this embodiment, the elastomer 22 is sewn onto or otherwise affixed to the interior panel 14 of the headband, and the exterior panel 12 and interior panel 14 are affixed together. The dashed lines of FIG. 6 indicate example locations where stitching may be used to sew the components together. These locations are merely examples, however, and other locations may be used (including, for example, the stitching patter 15 shown in FIGS. 1 and 2, which is not represented in FIG. 6. Further, although this embodiment shows the elastomer 22 being sewn directly to the interior panel 14, other embodiments may use other configurations, such as painting or otherwise affixing the silicone to an intermediate panel, and then affixing the intermediate panel to the interior and/or exterior panels 12, 14. An example of such a configuration is described below with reference to FIGS. 7 and 8. Such an embodiment may be desirable, for example, to avoid sewing through the elastomer, which could lead to reduced life of the elastomer.

In some embodiments, the elastomer 22 is sewn onto the exterior panel 12 and interior panel 14 of the headband 10. In some embodiments, the height of the elastomer 22 (e.g., its width in the lateral direction) is larger than the opening 20 of the interior panel 14, to more easily sew or otherwise affix the elastomer 22 to the interior panel 14 or exterior panel 12, and/or to hide the edge of the elastomer 22 from view. In some embodiments, such as the embodiment shown in FIG. 6, the headband is configured such that, when the exterior panel 14 of the headband 10 is resting against a flat horizontal surface, the elastomer 22 does not extend vertically above a plane defined by the uppermost edges of the interior panel 14 (e.g., with respect to the orientation of FIG. 6, a plane defined by the right-most edges of the interior panel 14, the plane being oriented perpendicular to the dashed lines). Stated another way, it can be desirable for the elastomer 22 to be visible within the opening 20, but to not extend outward (e.g., to the right with respect to the orientation of FIG. 6) beyond the opening 20. This may, for example, help to avoid a more visible lump being created when the headband is worn and/or to increase the long-term comfort and effectiveness of the headband by spreading the pressure of the elastomer 22 against the user's head over a larger surface area.

To use the headband 10, the headband 10 can be wrapped around the perimeter of the head 24 adjacent the hairline such that interior panel 14 is in direct contact with the head 24 (FIGS. 3-5). The elastomer 22 is positioned above the forehead and in direct contact with the skin. The second fastener 18 from the interior panel 14 is pressed against the first fastener 16 from the exterior panel 12 to secure the headband 10 to the head 24 while also ensuring a comfortable fit specific to the size of the user's head 24. This use of the headband 10 is preferred for individuals with no or little hair around the perimeter of the hairline, as the friction created by the contact of the elastomer 22 with the skin prevents the wig 26 from sliding back from the hairline.

The headband 10 may also be used by wrapping the headband 10 around the perimeter of the head 24 adjacent the hairline such that the exterior panel 12 is in direct contact with the head 24 (not shown). Using the headband 10 in this way is preferred for individuals with hair or who desire the fabric of the exterior panel 12 to rest against the head. Additionally, this use of the headband 10 permits the elastomer 22 to be in direct contact with the inner lining 28 of the wig 26, increasing friction between the two such that the wig 26 is prevented from slipping back from the hairline. As described, the headband 10 is desirably reversible, placing either the exterior panel 12 or interior panel 14 against the head 24.

By placing one fastener 16 on the exterior side of the headband and the other fastener 18 on the interior side of the headband, the fasteners 16 and 18 can be utilized in either orientation (i.e. with either the interior panel or the exterior panel positioned against the user's head). For example, as described above, if a user wishes to use the headband with the elastomer 22 in contact with their scalp, the user can place the first end of the headband that comprises the fastener 16 on the exterior surface against their head, wrap the rest of the headband around their head, and then lay the second end of the headband that comprises the fastener 18 over the top of the first end of the headband, thus engaging fastener 18 to fastener 16. As another example, if a user wishes to use the headband with the elastomer 22 in contact with the wig, the user can place the second end of the headband that comprises the fastener 18 against their head, wrap the rest of the headband around their head, and then lay the first end of the headband that comprises the fastener 16 over the top of the second end of the headband, thus also engaging fasteners 18 and 16. Although in this embodiment the first and second fasteners 16 and 18 are referred to individually as fasteners, the combination of the first and second fasteners 16 and 18 may also be referred to as an adjustable fastener. The adjustable fastener of the embodiment shown in FIGS. 1 and 2 comprises a first portion 16 of a hook and loop system and a second portion 18 of a hook and loop system. In this embodiment, the second portion 18 is desirably longer than the first portion 16. Accordingly, users that have different sized heads and/or that desire a tighter or looser fit may engage the first portion 16 to the second portion 18 at different locations with respect to the second portion 18. For example, if the first portion 16 engages the second portion 18 at the distal end of the second portion 18, the headband will form a larger diameter than if the first portion 16 engages a second portion at the proximal end of the second portion 18. Although the embodiment illustrated in FIGS. 1 and 2 utilizes a hook and loop system as an adjustable fastener, various other adjustable fasteners may be used, such as a plurality of buttons, hooks, snaps, and/or the like. For example, a hook and eye closure similar to as used in a brassiere may be used as an adjustable fastener.

Additional Wig-Retaining Headbands

Figure 7:
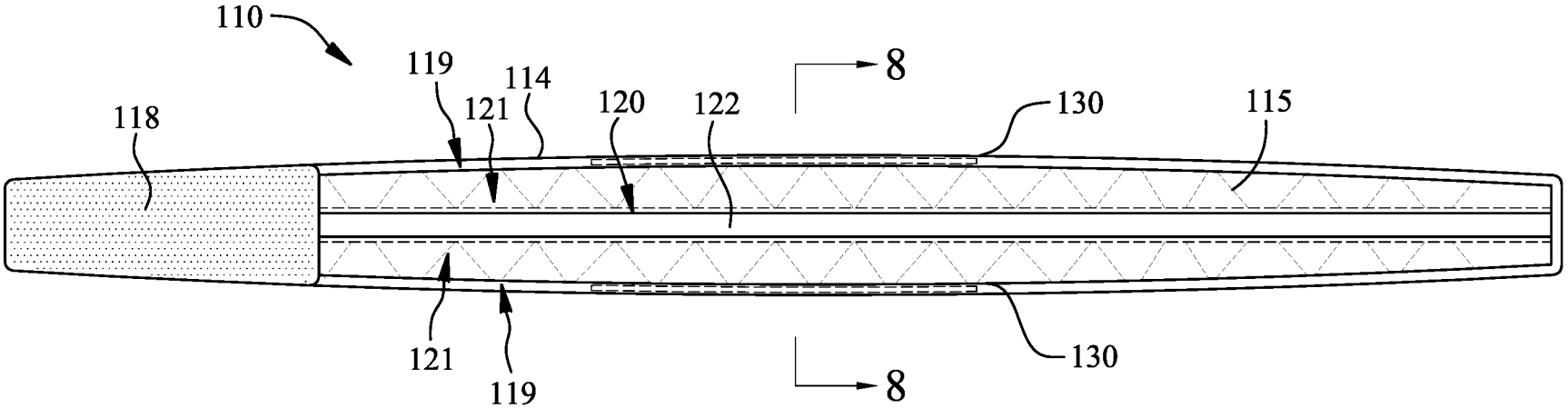
FIG. 7 shows the interior side of another embodiment of a headband.
Figure 8:
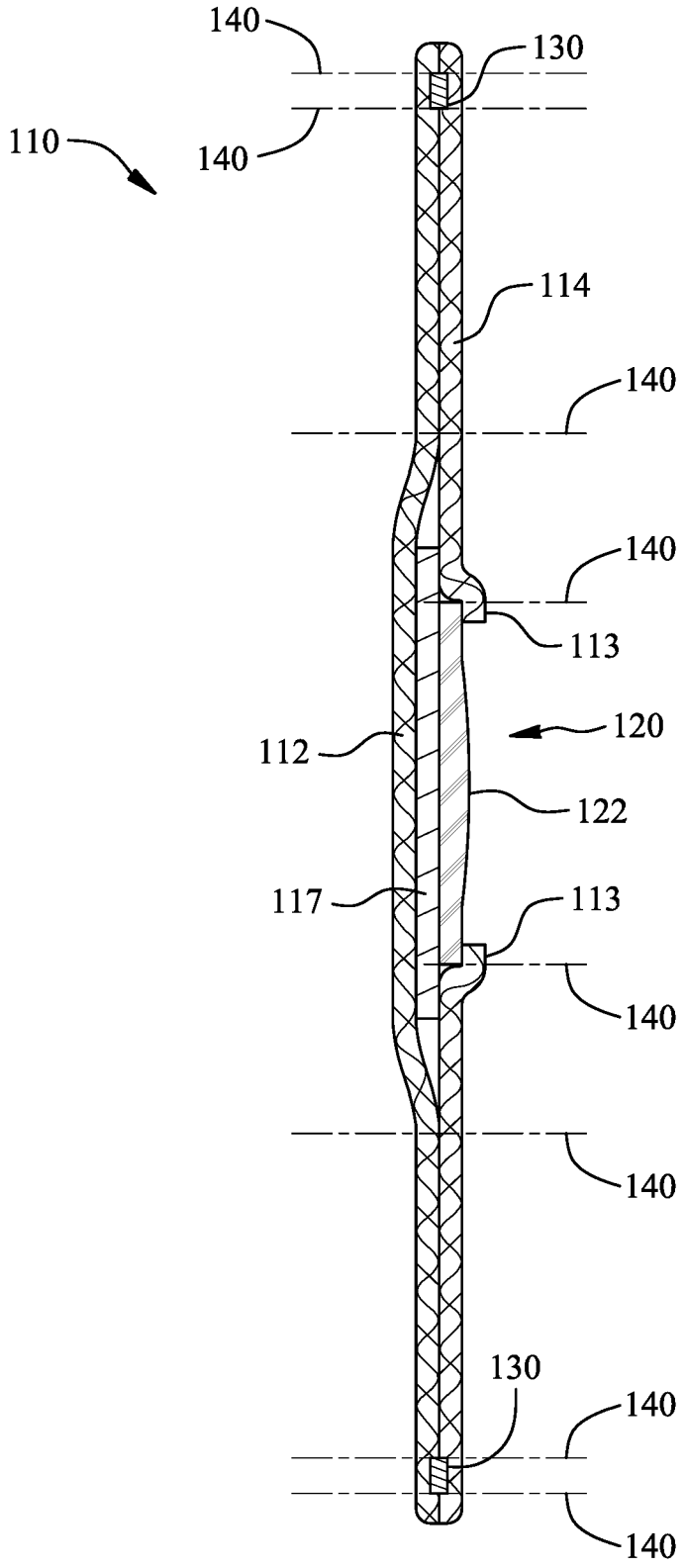
FIG. 8 is a cross-sectional view of the headband of FIG. 7, oriented as shown in FIG. 7.

FIGS. 7-8 illustrate another embodiment of a wig-securing headband, such as a headband 110. The headband 110 can include any of the features described above and the headband 10 can include any of the features described below. The headband 110 is similar to the headband 10 discussed above in many aspects. As shown in FIGS. 7-8, the headband 110 can include an exterior panel 112, an interior panel 114, an opening 120, an elastomer 122, such as silicone, and a fastener 118. The headband 110 can also include a second fastener on the exterior side of the headband that is not shown in FIG. 7, intended to couple with fastener 118 to form an adjustable fastener, similar to the operation of fasteners 16 and 18 of FIGS. 1 and 2. The headband 110 can include any one, or any combination, of the features of the headband 10. Likewise, the headband 10 can include any of the features of the headband 110, such as the elastic thread and/or intermediate layer discussed below.

The headband 110 can be an adjustable headband for securing a wig on a user's head. The headband 110 can be at least 20" long. The headband 110 can be less than 23" long. For example, in some embodiments, the headband 110 is 21.25" long or 22" long. The headband 110 can be at least 1" wide. The headband 110 can be less than 3" wide. For example, in some embodiments, the headband 110 can be 2.25" wide. The elastomer 122 can be less than 1" wide. For example, the elastomer 122 can be 0.8" wide or 0.9" wide. The elastomer 122 can be approximately 0.25 mm thick, either measured on its own or as a measurement of the combined thickness of the elastomer 122 with a substrate (such as the intermediate panel 117 described below). In some embodiments, the thickness can be no greater than 0.20 mm, 0.25 mm, 0.30 mm, 0.35 mm, 0.40 mm, 0.45 mm, or 0.50 mm. It can be desirable to limit the thickness, such as to limit the appearance of a "bump" or other protrusion when positioned on the user's head.

The exterior panel 112 and/or the interior panel 114 can comprise velvet, velour, cotton, and/or any other suitable material for a headband. The exterior panel 112 and/or the interior panel 114 can extend along a length of the headband 110. The exterior panel 112 and/or the interior panel 114 can be less than 1 mm thick. The headband 110 can include one or more adjustable fasteners configured to detachably couple a first end of the headband 110 to a second end of the headband 110 in different relative positions to adjust a fit of the headband 110 on the user's head 24. The exterior panel 112 can comprise a first fastener 116 and the interior panel 114 can comprise a second fastener 118 configured to engage the first fastener 116. The fasteners 116, 118 can comprise a hook-and-loop system, a snap fit closure, a clasp closure, and/or any other suitable fastener for a headband 110. The first fastener 116 can be shorter than the second fastener 118. For example, in some embodiments, the first fastener 116 is 0.5"-1.5" long and the second fastener 118 is 1.5"-3.5" long. Such a configuration can enable the user to adjust the fit of the headband 110.

As previously discussed, the exterior panel 112 and the interior panel 114 can have different features. For example, in some embodiments, the interior panel 114 includes an opening 120 exposing at least a portion of the elastomer 122 and the exterior panel 112 does not include any openings. In some embodiments, the interior panel 114 forms an opening 120 on an interior side of the headband 110. In some embodiments, as illustrated in FIG. 7, the interior panel 114 comprises two sub-panels 121, a first sub-panel 121 disposed above the opening 120 and/or the elastomer 122 and a second sub-panel 121 disposed beneath the opening 120 and/or the elastomer 122. For example, in some embodiments, the interior panel 114 comprises at least two pieces of fabric separated laterally by the opening 120. The sub-panels 121 can extend longitudinally along the length of the headband 110. The opening 120 and/or the elastomer 122 can extend longitudinally along the length of the headband 110. In some embodiments, the opening 120 and/or the elastomer 122 extends longitudinally along the entire length of the headband 110 with a portion of the opening 120 and/or the elastomer 122 being covered and/or disposed beneath the fastener 118. In some embodiments, the opening 120 and/or the elastomer 122 extends longitudinally along a portion of the length of the headband 110. In some embodiments, the opening 120 and/or the elastomer 122 (or the visible portion thereof, if some is covered, such as by the fastener 118) extends longitudinally along at least 70% of a length of the headband 110. In some embodiments, the opening 120 and/or the elastomer 122 (or the visible portion thereof, if some is covered, such as by the fastener 118) extends longitudinally along at least 50%, 60%, 75%, 80%, 85%, 90%, 95%, or 100% of a length of the headband 110.

The headband 110 can be reversible such that the user can place the exterior panel 112 or the interior panel 114 in contact with his or her head 24 when wearing the headband 110. For users without hair, it can be advantageous to wear the headband 110 with the interior panel 114 facing the user's head 24. In this arrangement, the elastomer 122 can contact the user's head 24 and act as a grip on the user's head 24 to prevent the headband 110 from slipping relative to the user's head 24. For users with hair, it can be advantageous to wear the headband 110 with the exterior panel 112 facing the user's head 24. In this arrangement, the elastomer 122 can face in a direction away from the user's head 24, contacting the inner lining 28 of a wig 26 and acting as a grip for the wig 26 to prevent the wig 26 from slipping relative to the headband 110 and thus relative to the user's head 24.

As shown in FIG. 7, the headband 110 can have edges 119. In some embodiments, the headband 110 can include at least one elastic thread (or elastic band) 130. For example, the headband 110 can include a first elastic thread 130 along the top of the headband 110 (e.g., within the upper edge 119) and a second elastic thread 130 along the bottom of the headband 110 (e.g., within the lower edge 119). The first elastic thread 130 can be parallel to the second elastic thread 130. The elastic thread 130 can be a thin elastic band. The elastic thread 130 can be at least 3" in length. The elastic thread can be less than 6.5" in length. For example, in some embodiments, the elastic thread 130 is 5.5" in length. The elastic thread 130 can be disposed towards the center of the length of the headband 110. When a user is wearing the headband 110, the elastic thread 130 can be positioned adjacent to the user's forehead. For example, a 5.5" long elastic thread 130 can be centered on the headband 110 such that the elastic thread 130 extends 2.75" left of center and 2.75" right of center. The elastic thread 130 may be retained within a stitching pattern that extends along the edges 119, such as a satin stitch, a blanket stitch, and/or any other suitable stitching pattern. In some embodiments, the elastic thread 130 may be positioned between the panels 112, 114, and in some embodiments, the elastic thread 130 may be positioned on top of a panel 112, 114.

The elastic thread 130 can advantageously allow for the headband 110 to sit more firmly and/or more evenly on the user's head 24. By helping to hold the headband 110 down (or at least hold the edges 119 down) and enabling the headband 110 to hug the crown of the user's head 24 more firmly, the elastic thread 130 can prevent material from bunching up or creating bulk under a wig 26.

In some embodiments, the headband 110 can include an antibacterial thread that helps to, for example, keep the headband clean and/or sanitary with extended use. The antibacterial thread may be used for any of the stitching patters discussed herein, such as, for example, the desirably diagonal patterns 15, 115, the stitching at edges 19, 119, stitching that retains the elastomer 22, 122 and/or the intermediate panel 117 to the interior and/or exterior panels 12, 112, 14, 114, and/or the like.

FIG. 8 is a cross sectional view of the headband 110. As illustrated in FIG. 8, the headband 110 can include a plurality of layers. For example, the headband 110 can include exterior panel 112, interior panel 114, elastomer 122, and an intermediate layer 117. The intermediate layer 117 can be disposed between the exterior panel 112 and the interior panel 114. The intermediate layer 117 can comprise a fabric, such as cotton, that is configured to be sewn into. Other suitable materials may also be used. In some embodiments, the headband 110 comprises velour, cotton, and silicone.

During the assembly of the headband 110, the elastomer 122 (e.g., a silicone member) can be coupled to the intermediate layer 117. For example, the elastomer 122 can be painted on to, glued to, or otherwise adhered to the intermediate layer 117. The elastomer 122 can be coupled to the intermediate layer 117 in a central region of the intermediate layer 117 such that a portion of the intermediate layer 117 extends above and below the elastomer 122. The intermediate layer 117 can extend at least 1/10" above and at least 1/10" below the elastomer 122. For example, in some embodiments, the intermediate layer 117 extends 1/8" above and 1/8" below the elastomer 122.

The exterior panel 112 and/or the interior panel 114 can be coupled to the intermediate layer 117 during a sewing process. For example, in some embodiments, the intermediate layer 117 can be connected to at least the interior panel 114 by stitching that extends along a perimeter of the opening 120 (represented by the dashed lines that extend along the perimeter of the opening 120 in FIG. 7, and by the dashed lines 140 positioned at the perimeter of the opening 120 in FIG. 8). The interior panel 114 can be attached to the intermediate layer 117 by sewing along an upper edge of the intermediate layer 117 and along a lower edge of the intermediate layer 117 (e.g., the portions of the intermediate layer 117 that extend above and below the elastomer 122). This arrangement enables the elastomer 122 to be integrated into the headband 110 without sewing into the elastomer 122 directly. The integrity of an elastomer 122, such as silicone, can be altered if sewn into directly. For example, silicone can break and crack easily when sewn into directly. Sewing into the intermediate layer 117 to which the elastomer 122 is fixed, rather than sewing into the elastomer 122 directly, can help maintain the integrity of the elastomer 122. In some embodiments, however, the elastomer may be sewn into. In the embodiment of FIG. 8, an assembly process desirably comprises attaching the intermediate layer 117 to the interior panel 114, and then attaching the interior panel 114 to the exterior panel 112. Other techniques may be used, however.

In some embodiments, the exterior panel 112, interior panel 114, intermediate layer 117, and elastomer 122 are assembled and/or positioned so that at least a portion of the elastomer 122 is disposed within and/or exposed through the opening 120 of the interior panel 114 (e.g., exposed through the opening 120 on the interior side of the headband 110). Embedding an elastomer 122, such as silicone, in the headband 110 rather than placing the elastomer on top of the headband is advantageous for a variety of reasons. Embedding the elastomer 122 in the headband 110 can help hold the elastomer 122 steady and can reduce the bulkiness of the headband 110 by preventing the elastomer 122 from extending beyond the remainder of the headband 110. In addition, by embedding the elastomer 122, the elastomer 122 can be protected (e.g., from damage, cracking, stretching, and/or discoloration) in part by the exterior panel 112 on a first side of the elastomer 122 and/or by the interior panel 114 on a second side of the elastomer 122. In some embodiments, a portion of the interior panel 114 extends over a portion of the elastomer 122 (such as when the elastomer 122 is wider than the opening 122 in the interior panel 114). As shown in FIG. 8, the interior panel 114 can include an edge 113 that extends over an upper portion of the elastomer 122 and an edge 113 that extends over a lower portion of the elastomer 122. In some embodiments, the edges 113 may not extend over a portion of the elastomer 122.

FIG. 8 illustrates some example locations 140 where stitching can be, such as stitching around the edges of the headband, stitching around the edges of the opening 120, and/or stitching 115 shown in FIG. 7. Locations 140 are merely examples, and patterns of stitching may be located elsewhere. Also, the same or similar stitching as described above with reference to the embodiment of FIGS. 1-6 can be used with the embodiment of FIGS. 7 and 8. For example, in some embodiments, at least three patterns or types of stitching are used: namely, a first pattern of stitching that extends along the outer perimeter or edges 119 and may generally seal or at least partially hide the outer edges of the headband's panels, a second pattern of stitching (e.g., stitching 115) that extends along the perimeter of the opening 120, and a third pattern of stitching the extends between the outer perimeter or edges 119 and the perimeter of the opening 120. Any of these patterns of stitching may include straight lines of stitching, non-straight lines of stitching, decorative patterns of stitching, and/or the like.

In some embodiments, the second pattern of stitching 115 can comprise a plurality of lines extending diagonally between the perimeter of the headband 110 and the perimeter of the opening 120, or may take a variety of other forms, similar to as discussed above with reference to stitching 15. The lines of stitching 115 can comprise a series of diagonal lines of stitching forming generally triangular-shaped patterns. The lines of stitching 115 can be created using a mold, such as a wire mold. The mold can include channels to guide a sewing machine to form the triangular-shaped patterns. The mold can include two parallel panels having corresponding channels. The exterior panel 112 and the interior panel 114 can be aligned and placed between the two panels of the mold to help hold the material in place during sewing.

The triangular patterns formed by the lines of stitching 115 can help prevent the exterior panel 112 and the interior panel 114 from slipping relative to one another and can help hold the headband 110 taut. The lines of stitching 115 can hold the direction of the fabric (e.g., velvet, velour, etc.) of the exterior panel 112 and the interior panel 114. This can allow the headband 110 to feel smoother when pressure is applied in a first direction and rougher when pressure is applied in a second direction opposite the first direction, such that the headband 110 facilitates friction between the headband 110 and a wig 26 when the wig 26 brushes against the headband 110. This feature can help hold the wig 26 in position relative to the headband 110. In addition, the lines of stitching 115 can advantageously limit the amount that the headband 110 can stretch (e.g., reducing the amount the headband 110 can stretch longitudinally over the amount it could stretch if the stitching 115 were not present), thereby reducing the likelihood that the embedded elastomer 122 will crack and helping to preserve the integrity of the elastomer 122.

Additional Variations of Wig-Retaining Headbands

Figure 9:
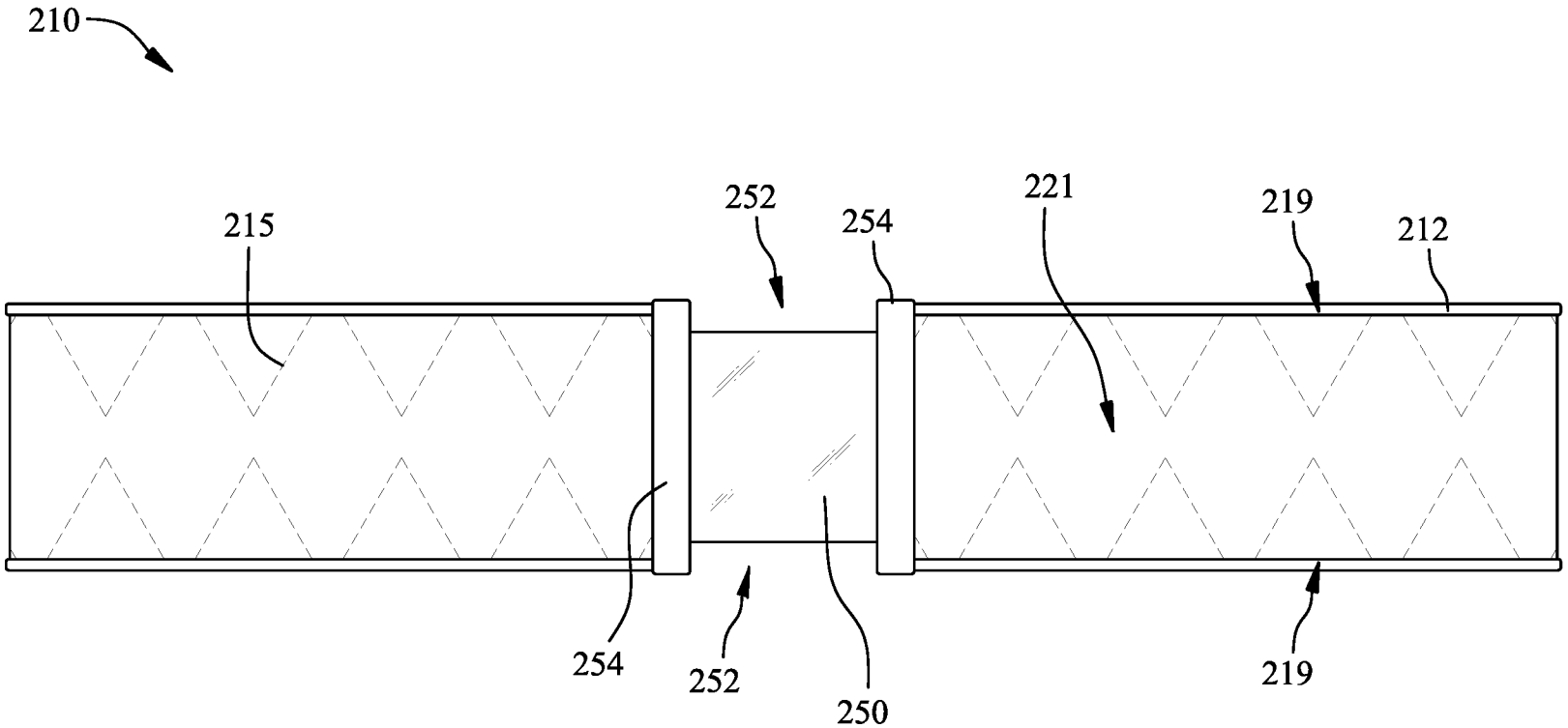
FIG. 9 shows the exterior side of another embodiment of a headband.

FIG. 9 illustrates another embodiment of a wig-securing headband, such as a headband 210. For clarity, FIG. 9 illustrates only a central portion of the exterior side of the headband 210. The rest of the headband 210 (e.g., the left and right ends) may be similar in design to the left and right ends shown in FIGS. 1, 2, and 7. The headband 210 can include any of the features described above and the headbands 10, 110 can include any of the features described below. The headband 210 can include any one, or any combination, of the features of the headbands 10, 110. Likewise, the headbands 10, 110 can include any of the features of the headband 210, such as the transparent segment discussed below.

As shown in FIG. 9, the headband 210 can include a transparent segment 250. The transparent segment 250 can be disposed in generally the center of the front of the headband 210, and/or in a portion that will be positioned at the center of a user's scalp when worn. The transparent segment 250 can be advantageous, because, for example, it can prevent the headband 210 from being visible (or at least reduce the headband's visibility) beneath the part area (e.g., the area of the wig where the hair parts) of a wig 26 that is made with lace or another relatively transparent material. This configuration can allow portions of the user's scalp to remain visible beneath the part area of the wig 26 when the user is wearing the headband 210 and the wig 26, which can improve the aesthetics and the authenticity of the wig 26.

The transparent segment 250 can comprise clear silk or other suitable materials. In some embodiments, the transparent segment 250 is not completely transparent, but is at least partially transparent. In some embodiments, the segment 250 is not transparent, but is rather colored a color that is intended to be similar to the user's skin color. In some embodiments, the segment 250 is partially transparent and is also colored a color that is intended to be similar to the user's skin color. The transparent segment 250 can be less than 1.5" long. For example, in some embodiments, the transparent segment 250 can be 1" long. The transparent segment 250 can be less than 3" wide. The transparent segment 250 can be greater than 1" wide. For example, in some embodiments, the transparent segment 250 is 2.5" wide. Each lateral side of the transparent segment 250 can be coupled to a lateral edge of the exterior panel 212 and/or interior panel 214. In some embodiments, the headband 210 includes a reinforcement 254 disposed to the left and right of the transparent segment 250 that can help hold the transparent segment 250 firmly in place. Each of the lateral sides of the transparent segment 250 can be sewn to the headband 210 along a curve, allowing the transparent segment 250 to better conform to a user's head 24 and enabling the headband 210 to rest more firmly on the user's scalp.

As illustrated in FIG. 9, the transparent segment 250 can be less wide than the exterior panel 212. For example, in some embodiments, the headband 210 includes a gap 252 in material above the transparent segment 250 and a gap 252 in material below the transparent segment 250. This configuration can advantageously help to further prevent the headband 210 from being visible (or at least further reduce the headband's visibility) beneath the part area (e.g., the area of the wig where the hair parts) of a wig 26 that is made with lace or another relatively transparent material.

Figure 10:
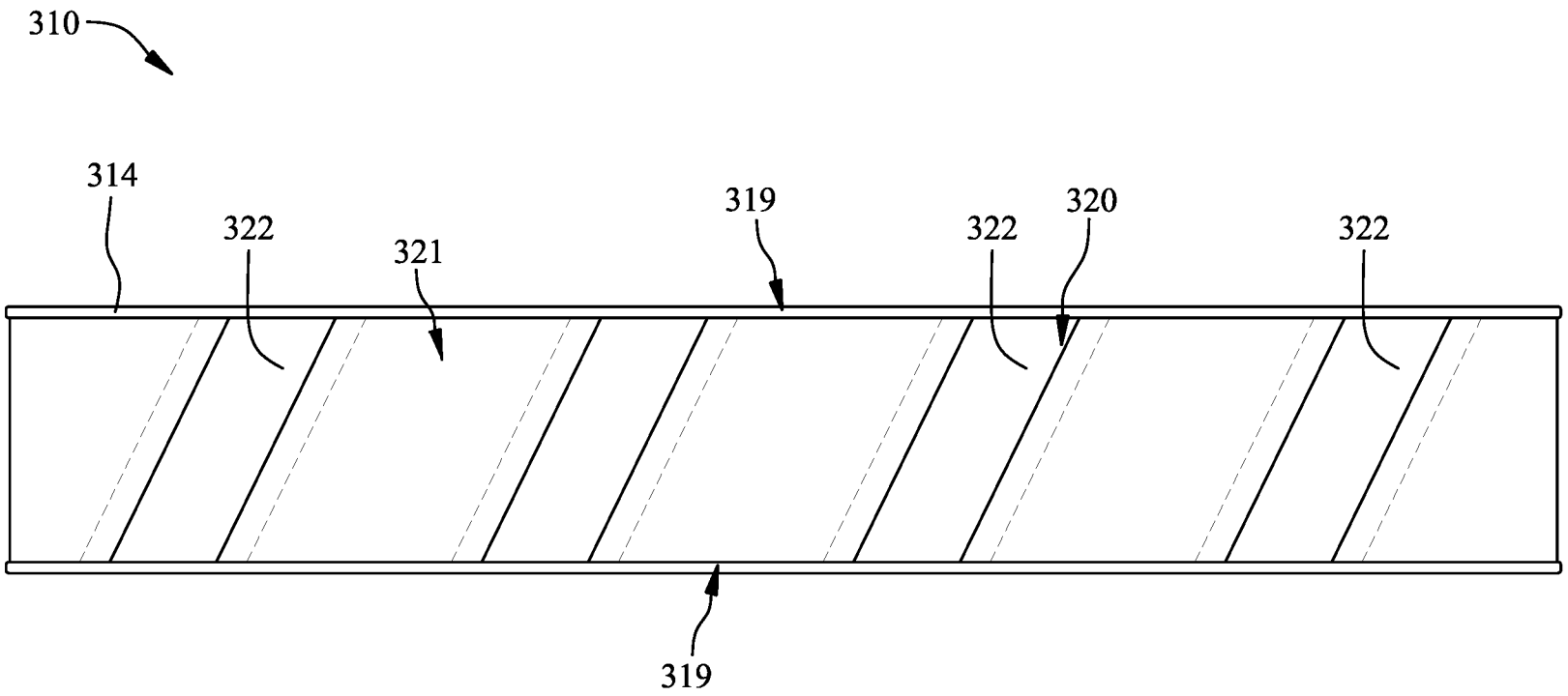
FIG. 10 shows the interior side of another embodiment of a headband.

FIG. 10 illustrates another embodiment of a wig-securing headband, such as a headband 310. For clarity, FIG. 10 illustrates only a central portion of the interior side of the headband 310. The rest of the headband 310 (e.g., the left and right ends) may be similar in design to the left and right ends shown in FIGS. 1, 2, and 7. The headband 310 can include any of the features described above and the headbands 10, 110, 210 can include any of the features described below. The headband 310 can include any one, or any combination, of the features of the headbands 10, 110, 210. Likewise, the headbands 10, 110, 210 can include any of the features of the headband 310, such as the slanted elastomers and plurality of elastomers discussed below.

As shown in FIGS. 2 and 7, the headbands 10 and 110 can include an elastomer 22, 122, such as a strip of silicone, extending along a longitudinal axis of the headband. In some embodiments, such as headbands 10 and 110 discussed above, the headband includes only a single elastomer. Some embodiments, however, can include a plurality of elastomers 22, 122. For example, the headbands 10, 110 can be modified to include first and second elastomers 22 extending along the longitudinal axis of the headband, where the second elastomer 22 is parallel to the first elastomer 22. Further, any number of elastomers may be used, such as three, four, five, or more, and they may or may not be parallel to one another. Further, they may or may not be parallel with the longitudinal axis of the headband.

FIG. 10 illustrates an example embodiment that includes multiple elastomers that are parallel to one another, but that are not parallel to the longitudinal axis of the headband. As shown in FIG. 10, the headband 310 can include a plurality of spaced apart elastomers 322 that are positioned at an angle relative to vertical (e.g., slanted, extending diagonally, etc.). For example, the headband 310 can include three or more elastomers 322 (e.g., four elastomers, five elastomers, etc.). The elastomers 322 can be short strips of silicone. For example, the elastomers 322 can be less than 1" wide and less than 3" long. In some embodiments, the elastomers 322 are 0.5" wide and 2" long. The elastomers 322 can be spaced apart along the longitudinal axis of the headband 310 by less than 3". The elastomers 322 can be spaced apart along the longitudinal axis of the headband 310 by more than 0.5". For example, in some embodiments, the elastomers 322 are spaced apart from one another along the longitudinal axis of the headband 310 by 2". The construction of headband 310 may be similar to any of the constructions described above, other than the different arrangement of the elastomers. For example, the exterior panel (not shown in FIG. 10) may be similar to as shown in FIG. 1, and the interior panel 314 may be similar to the multi-part interior panel 114 of FIG. 7, except that the multiple parts of the interior panel 314 are separated longitudinally instead of laterally. The dashed lines to the right and left of each opening 320 represent stitching locations where the interior panel and/or the exterior panel can be attached to the elastomer 322 (either directly, like as shown in FIG. 6, or indirectly via an intermediate layer, like as shown in FIG. 8).

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment. The headings used herein are for the convenience of the reader only and are not meant to limit the scope of the inventions or claims.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. Additionally, the skilled artisan will recognize that any of the above-described methods can be carried out using any appropriate apparatus. Further, the disclosure herein of any particular feature, aspect, method, property, characteristic, quality, attribute, element, or the like in connection with an embodiment can be used in all other embodiments set forth herein. For all of the embodiments described herein the steps of the methods need not be performed sequentially. Thus, it is intended that the scope of the present inventions herein disclosed should not be limited by the particular disclosed embodiments described above. The ranges disclosed herein also encompass any and all overlap, subranges, and combinations thereof. Moreover, language such as "up to," "at least," "greater than," "less than," "between," and the like includes the number recited. Numbers or qualities or characteristics or amounts or quantities preceded by a term such as "approximately", "about", and "substantially" as used herein include the recited numbers (e.g., about 10%=10%), and also represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount.

While particular forms of the inventions have been illustrated and described, it will also be apparent to those skilled in the art that various modifications can be made without departing from the spirit and scope of the invention. Accordingly, it is not intended that the invention be limited except by the appended claims.

Insofar as the description above and the accompanying drawing disclose any additional subject matter that is not within the scope of the claims below, the inventions are not dedicated to the public and the right to file one or more applications to claim such additional inventions is reserved.

What is claimed is:

1. An adjustable headband for securing a wig on a user's head, the adjustable headband comprising:

an exterior panel that extends along a length of the headband, the exterior panel comprising a crushed velvet or velour material that has a pile oriented toward a lateral edge of the headband;

an interior panel that forms an opening on an interior side of the headband, the opening extending longitudinally along the length of the headband;

an intermediate layer disposed between the exterior panel and the interior panel, the intermediate layer connected to at least the interior panel by stitching that extends along a perimeter of the opening, wherein the exterior panel is connected to the interior panel by at least a first pattern of stitching that extends along a perimeter of the headband and a second pattern of stitching that extends from the perimeter of the headband to the perimeter of the opening;

a silicone member coupled to the intermediate layer and positioned to be exposed through the opening on the interior side of the headband with the silicone member extending longitudinally along the length of the headband, wherein an edge of the intermediate layer extends beyond an edge of the silicone member such that the silicone member is positioned without the stitching that extends along a perimeter of the opening extending into the silicone member; and one or more adjustable fasteners configured to detachably couple a first end of the headband to a second end of the headband in different relative positions to adjust a fit of the headband on the user's head.

2. The headband of claim 1, wherein the second pattern of stitching comprises a plurality of lines extending diagonally from the perimeter of the headband to the perimeter of the opening.

3. The headband of claim 1, wherein the interior panel comprises at least two pieces of fabric separated laterally by the opening.

4. A headband for securing a wig on a user's head, the headband comprising:

an exterior panel comprising a crushed velvet or velour material that has a pile oriented toward a lateral edge of the headband;

an interior panel, the interior panel comprising an opening extending along a longitudinal direction;

an intermediate layer disposed between the exterior panel and the interior panel, the intermediate layer connected to at least the interior panel by stitching that extends along a perimeter of the opening; and a silicone member coupled to the intermediate layer, the silicone member extending along the longitudinal direction, with at least a portion of the silicone member disposed in the opening of the interior panel, and wherein an edge of the intermediate layer extends beyond an edge of the silicone member such that the silicone member is positioned without the stitching that extends along the perimeter of the opening extending into the silicone member.

5. The headband of claim 4, wherein the interior panel comprises at least two pieces of fabric separated laterally by the opening.

6. The headband of claim 4, wherein the interior panel is attached to the intermediate layer at an upper edge and a lower edge of the intermediate layer, the silicone member disposed between the upper edge and the lower edge of the intermediate layer.

7. The headband of claim 4, wherein the exterior panel comprises a first fastener and the interior panel comprises a second fastener configured to engage the first fastener.

8. The headband of claim 4, wherein the headband is reversible such that each of the exterior panel and the interior panel can be configured to contact the user's head.

9. The headband of claim 4, further comprising diagonal stitching extending from a perimeter of the headband to a perimeter of the opening, the diagonal stitching configured to reduce relative movement between portions of the exterior panel and portions of the interior panel.

10. The headband of claim 4, further comprising a first elastic thread and a second elastic thread parallel to the first elastic thread, wherein the first elastic thread extends longitudinally along a central upper portion of the headband and the second elastic thread extends longitudinally along a central lower portion of the headband.

11. The headband of claim 4, wherein the interior panel is coupled to the exterior panel with stitching that extends from a perimeter of the headband to the perimeter of the opening.

12. A headband for securing a wig on a user's head, the headband comprising:

a first panel, the first panel comprising a crushed velvet or velour material that has a pile oriented toward a lateral edge of the headband;

a second panel, the second panel comprising an opening extending along a longitudinal direction, wherein the second panel is coupled to the first panel with stitching that extends from a perimeter of the headband to a perimeter of the opening;

an intermediate layer disposed between the first panel and the second panel, wherein the intermediate layer is coupled to at least the second panel with stitching that extends along the perimeter of the opening;

an elastomer coupled to the intermediate layer, wherein at least a portion of the elastomer is disposed in the opening of the second panel and extends along the longitudinal direction, wherein an edge of the intermediate layer extends laterally beyond an edge of the elastomer; and one or more adjustable fasteners configured to detachably couple a first end of the headband to a second end of the headband in different relative positions to adjust a fit of the headband on the user's head.

13. The headband of claim 12, wherein the second panel comprises at least two pieces of fabric separated laterally by the opening.

14. The headband of claim 12, wherein the elastomer comprises a first silicone member extending along the longitudinal direction.

15. The headband of claim 12, wherein the first panel comprises a first fastener of the one or more adjustable fasteners and the second panel comprises a second fastener of the one or more adjustable fasteners, the second fastener configured to engage the first fastener.

16. The headband of claim 12, further comprising a first elastic thread and a second elastic thread parallel to the first elastic thread, wherein the first elastic thread extends longitudinally along a central upper portion of the headband and the second elastic thread extends longitudinally along a central lower portion of the headband.

17. The headband of claim 12, further comprising a transparent segment, the transparent segment configured to contact a region of the user's head that aligns with the location of the wig where hair parts.

18. The headband of claim 12, wherein the stitching that extends along the perimeter of the opening does not pass through the elastomer.

* * * * *